US010245197B2

(12) United States Patent
Sheth

(10) Patent No.: US 10,245,197 B2
(45) **Date of Patent: *Apr. 2, 2019**

(54) SYSTEM AND METHOD FOR TREATING AND PREVENTING PRESSURE SORES IN BEDRIDDEN PATIENTS

(71) Applicant: Piyush Sheth, Porter Ranch, CA (US)

(72) Inventor: Piyush Sheth, Porter Ranch, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/639,895

(22) Filed: Jun. 30, 2017

(65) Prior Publication Data

US 2018/0369040 A1 Dec. 27, 2018

Related U.S. Application Data

(60) Provisional application No. 62/523,261, filed on Jun. 22, 2017.

(51) Int. Cl.
*A61G 7/05* (2006.01)
*A61G 7/10* (2006.01)
(Continued)

(52) U.S. Cl.
CPC ..... *A61G 7/05776* (2013.01); *A61G 7/1019* (2013.01); *A61H 9/005* (2013.01);
(Continued)

(58) Field of Classification Search
CPC ..... A61G 7/05576; A61G 7/0005; A47C 27/083; A61B 5/1036; A61B 5/6892
See application file for complete search history.

(56) References Cited

U.S. PATENT DOCUMENTS 3,605,145 A * 9/1971 Graebe ..... A47C 27/081 297/DIG. 3
3,893,198 A 7/1975 Blair
(Continued)

FOREIGN PATENT DOCUMENTS

CN 105362059 A 3/2016
EP 2047831 A1 4/2009

OTHER PUBLICATIONS

Roho Prodigy Mattress System—Inflatable Mattress Overlay Air Cushion retrieved from the Internet URL https://www.exmed.net/p-2089-roho-prodigy-mattress-system-inflatable-mattress-overlay-air-cushion.aspx?defaultvariantid=21007&gclid=cozurbl57dqcfynpfgoddu0d9q on Jul. 5, 2017.
(Continued)

*Primary Examiner* — Eric J Kurilla
(74) *Attorney, Agent, or Firm* — Procopio Cory Hargreaves and Savitch LLP

(57) ABSTRACT

A system such as a hospital bed provides capability to monitor and alleviate the pressure points and provides oxygen and water jets to prevent and treat bed sores in bed-ridden patients. An array of balloons touching each other form a mattress of unstitched but contiguous balloons like in a conventional mattress with stitched puffs. Individual pressure sensors placed within each balloon measure and monitor pressure. Furthermore, horizontal rods which lay between the balloons perform oxygenation and provide water massage to the back of the patient body from the interstitial spaces within the unstitched mattress of contiguous balloons. The rods are elevated to raise the patient above the mattress to relieve overall pressure and enable cleaning and wipe down of the back of the patient body. The rods can elevate the entire patient body or its torso alone or the lower extremities alone to clean as desired.

12 Claims, 3 Drawing Sheets

(51) Int. Cl.
*A61G 7/057* (2006.01)
*A61H 9/00* (2006.01)

(52) U.S. Cl.
CPC ..... *A61G 2203/10* (2013.01); *A61G 2203/34* (2013.01); *A61H 2201/5071* (2013.01); *A61H 2203/0431* (2013.01); *A61H 2203/0456* (2013.01)

(56) References Cited

U.S. PATENT DOCUMENTS 5,025,515 A * 6/1991 Rhines ..... A47K 3/06 4/584
5,192,304 A * 3/1993 Rassman ..... A61H 9/0078 5/933
5,341,820 A 8/1994 Hammett
5,446,933 A * 9/1995 Gabelhouse ..... A47C 23/002 5/670
5,704,083 A * 1/1998 Nerg ..... A61G 7/0005 5/600
6,212,719 B1 * 4/2001 Thomas ..... A47C 4/54 297/284.6
6,487,738 B1 * 12/2002 Graebe ..... A47C 23/043 267/82
6,560,803 B2 * 5/2003 Zur ..... A61G 5/1043 297/284.6
6,581,225 B1 * 6/2003 Imai ..... A61G 7/057 5/421
6,823,549 B1 * 11/2004 Hampton ..... A61G 7/05776 297/284.6
6,829,797 B2 * 12/2004 Partian ..... A61G 7/057 5/710
7,013,511 B2 3/2006 Maschke
7,520,011 B1 * 4/2009 Liberkowski ..... A47C 23/002 5/719
8,863,338 B2 * 10/2014 Dzioba ..... A61G 7/05776 5/655.3
9,591,995 B2 * 3/2017 Blumberg ..... A47C 23/002
2001/0039681 A1 11/2001 Johnson et al.
2004/0045090 A1 * 3/2004 Tsai ..... A47C 27/084 5/709
2006/0085919 A1 * 4/2006 Kramer ..... A47C 27/082 5/713
2006/0112489 A1 * 6/2006 Bobey ..... A61B 5/1115 5/655.3
2011/0061159 A1 * 3/2011 Mardirossian ..... A47K 3/282 4/611
2011/0239370 A1 10/2011 Turo et al.
2013/0061385 A1 * 3/2013 Al-Madi ..... A61G 7/0005 4/546
2014/0041127 A1 2/2014 Codos
2015/0026895 A1 1/2015 Geelen et al.

OTHER PUBLICATIONS

Buhr, Sarah, "Purple, a Utah mattress startup you've probably never heard of, is on track to unicorndom", Tech Crunch, posted Apr. 13, 2017, retrieved from the Internet URL https://techcrunch.com/2017/04/13/purple-a-utah-mattress-startup-youve-probably-never-heard-of-is-on-track-to-unicorndom/ on Jul. 5, 2017.
International Search Report and Written Opinion for International Patent Application No. PCT/US2018/036124 dated Nov. 6, 2018 in 14 pages.

* cited by examiner

SYSTEM AND METHOD FOR TREATING AND PREVENTING PRESSURE SORES IN BEDRIDDEN PATIENTS

CROSS-REFERENCE TO RELATED APPLICATIONS

This application claims priority to U.S. Provisional Patent Application No. 62/523,261, filed on Jun. 22, 2017, which is incorporated by reference herein.

FIELD OF THE INVENTION

The present invention relates to systems and methods for treating and preventing pressure sores in bedridden patients.

BACKGROUND OF THE INVENTION

Currently there are a number of attempts for treating pressure sores like air-loss beds and pressure mapping systems. Some of these attempts map the pressure on the back of the patient body but these solutions fail to prevent and/or treat pressure sores. Other attempts try to reduce pressure, but these solutions do not relieve the pressure points on the patients back especially the sacral layers and the heels/ankles. None of these attempts seek to address how to increase the oxygenation in the sore areas.

It would be desirable to have a pressure monitoring bed which will enable mapping of the pressure on the patient body. Furthermore, it would also be desirable to have ability to reduce pressure at sore points. This reduction in pressure at one location will cause the high pressure point to shift to a different location. But if there is an easy system to keep alternating high pressure points between different locations along with total pressure relief by elevation, oxygenation and water massage with ability to clean the patient's back dry and apply topical moisturizers etc., would prevent sores. Furthermore, it would also be desirable to have mechanics in the bed to elevate the patient to clean his back. Still further, it would be desirable to provide oxygenation and massage the back of the patient body. Therefore, there currently exists a need in the industry for a hospital bed for chronically ill patients to prevent and treat pressure sores.

SUMMARY OF THE INVENTION

An aspect of the invention involves a hospital bed for chronically ill patients to prevent and treat pressure sores. The hospital bed includes horizontal and vertical rows of balloons with embedded pressure sensors, rods with holes for oxygenation and water-jets, pneumatic actuators and a pressure mapping system to monitor pressure. These components are connected as follows—the array of balloons forms an unstitched mattress when the patient rests on it and allows for monitoring of pressure in each balloon allowing adjusting the pressure in the balloon as required. The horizontal rods lay within the array of balloons to allow oxygenation and water jet massage of the back of the patient body through the interstitial space between the balloons.

The device may also have one or more of the following: Ability to lift the entire patient body or the torso-alone or the lower extremities to enable relieving pressure in respective areas and enable better cleaning and drying of the patient body for good hygiene.

Another aspect of the invention involves a hospital bed with the capability to monitor and alleviate the pressure points and provides oxygen and water jets to prevent and treat bed sores in bed-ridden patients. An array of balloons touching each other form a mattress of unstitched but contiguous balloons like in a conventional mattress with stitched puffs. Individual pressure sensors placed within each balloon measure and monitor pressure. Furthermore, horizontal rods which lay between the balloons perform oxygenation and provide water massage to the back of the patient body from the interstitial spaces within the unstitched mattress of contiguous balloons. The rods are elevated to raise the patient above the mattress to relieve overall pressure and enable cleaning and wipe down of the back of the patient body. The rods can elevate the entire patient body or its torso alone or the lower extremities alone to clean as desired.

A further aspect of the invention involves a system for preventing and treating pressure sores of a patient. The system includes an array of expandable and collapsible supports to support and provide pressure relief to a patient in pressure locations where the expandable and collapsible supports support the patient; pressure sensors associated with the expandable and collapsible supports to monitor pressure locations where the expandable and collapsible supports support the patient; a patient lift movable between the expandable and collapsible supports to elevate one or more areas of the patient, the patient lift including one or more oxygen emitters to oxygenate one or more areas of the patient.

One or more implementations of the aspect of the invention described immediately above includes one or more of the following: the system is a hospital bed; the system is a seat; the lift includes multiple actuators that elevate the patient to clean a back of the patient; the lift includes one or more water emitters to massage one or more areas of a back of the patient; the array of expandable and collapsible supports include interstitial spaces between the balloons and the one or more oxygen emitters are disposed in the interstitial spaces to emit oxygen there through to oxygenate one or more areas of the patient; the expandable and collapsible supports provide pressure relief and the one or more oxygen emitters provide oxygenation without elevating the patient with the patient lift; the expandable and collapsible supports are inflatable balloons; the inflatable balloons are embedded with the pressure sensors; the lift includes horizontal rods disposed between the expandable and collapsible supports, and the horizontal rods include the one or more oxygen emitters; and/or the lift includes one or more hinges, enabling the lift to lift one or more of the patient's torso alone, the patient's lower extremities alone, and the patient's entire body.

A still further aspect of the invention involves a method of preventing and treating pressure sores of a patient using the system described above. The method includes monitoring pressure in the expandable and collapsible supports using the pressure sensors; at least partially collapsing one or more expandable and collapsible supports based on the pressure in the expandable and collapsible supports to provide pressure relief to the patient in the pressure locations where the expandable and collapsible supports support the patient; and oxygenating one or more areas of the patient with the one or more oxygen emitters of the patient lift.

One or more implementations of the aspect of the invention described immediately above includes one or more of the following: the lift includes one or more water emitters to massage one or more areas of a back of the patient, and the method includes irrigating one or more areas of the back of the patient with the one or more water emitters of the patient lift; the array of expandable and collapsible supports include interstitial spaces between the balloons and the one or more water emitters are disposed in the interstitial spaces, and irrigating includes irrigating through the interstitial spaces the one or more areas of the back of the patient; the array of expandable and collapsible supports include interstitial spaces between the balloons and the one or more oxygen emitters are disposed in the interstitial spaces, and the method includes emitting oxygen through the interstitial spaces to oxygenate one or more areas of the patient; and/or moving the patient lift between the expandable and collapsible supports to elevate one or more areas of the patient.

The invention will now be described more fully hereinafter with reference to the accompanying drawings, which are intended to be read in conjunction with both this summary, the detailed description and any preferred and/or particular embodiments and variations specifically discussed or otherwise disclosed. This invention may, however, be embodied in many different forms and should not be construed as limited to the embodiments set forth herein; rather, these embodiments are provided by way of illustration only and so that this disclosure will be thorough, complete and fully conveys the full scope of the invention to those skilled in the art.

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENT OF THE INVENTION

Figure 1:
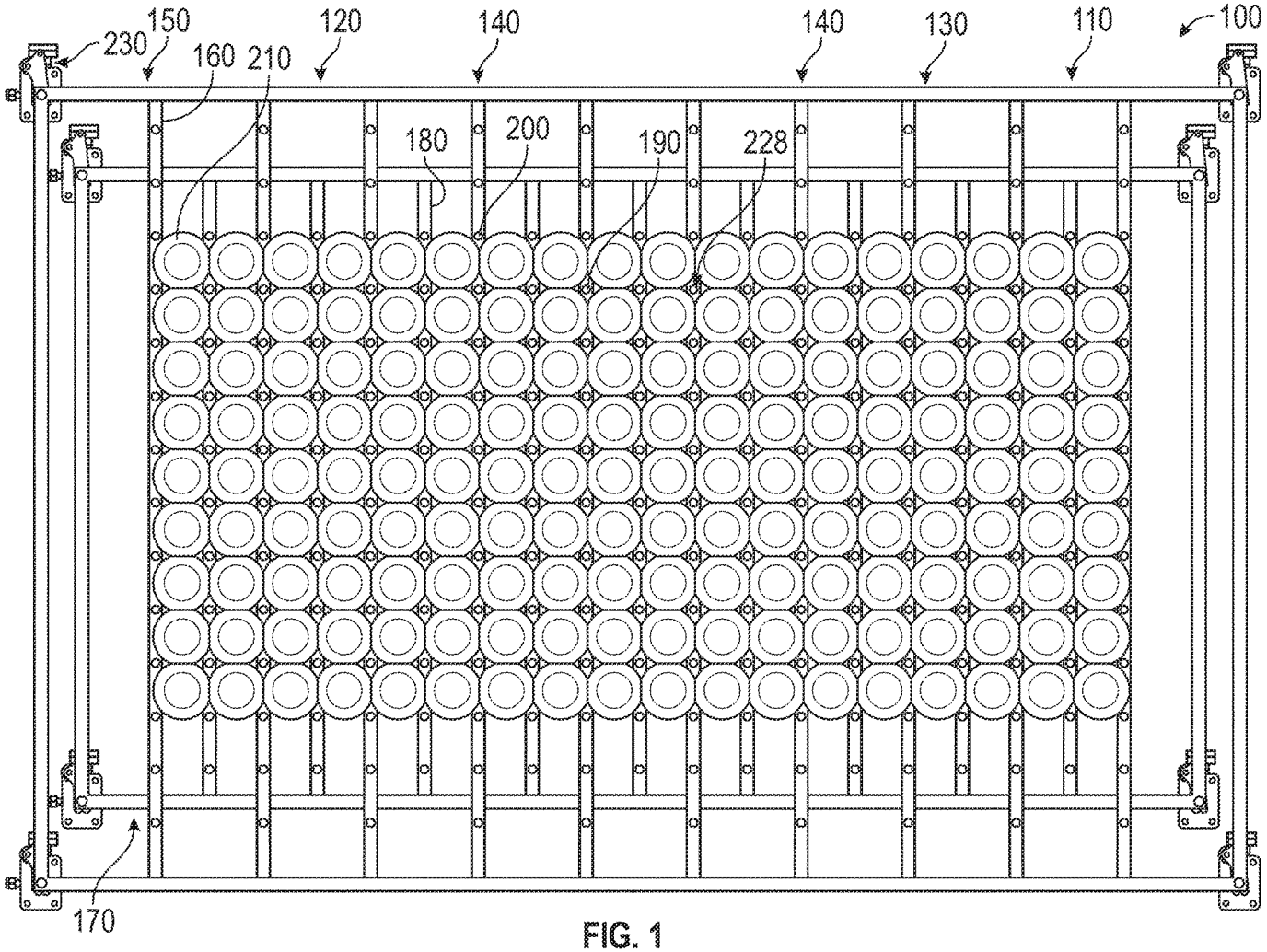
FIG. 1 is a top view of an embodiment of a system for treating and preventing pressure sores in bedridden patients.
Figure 2:
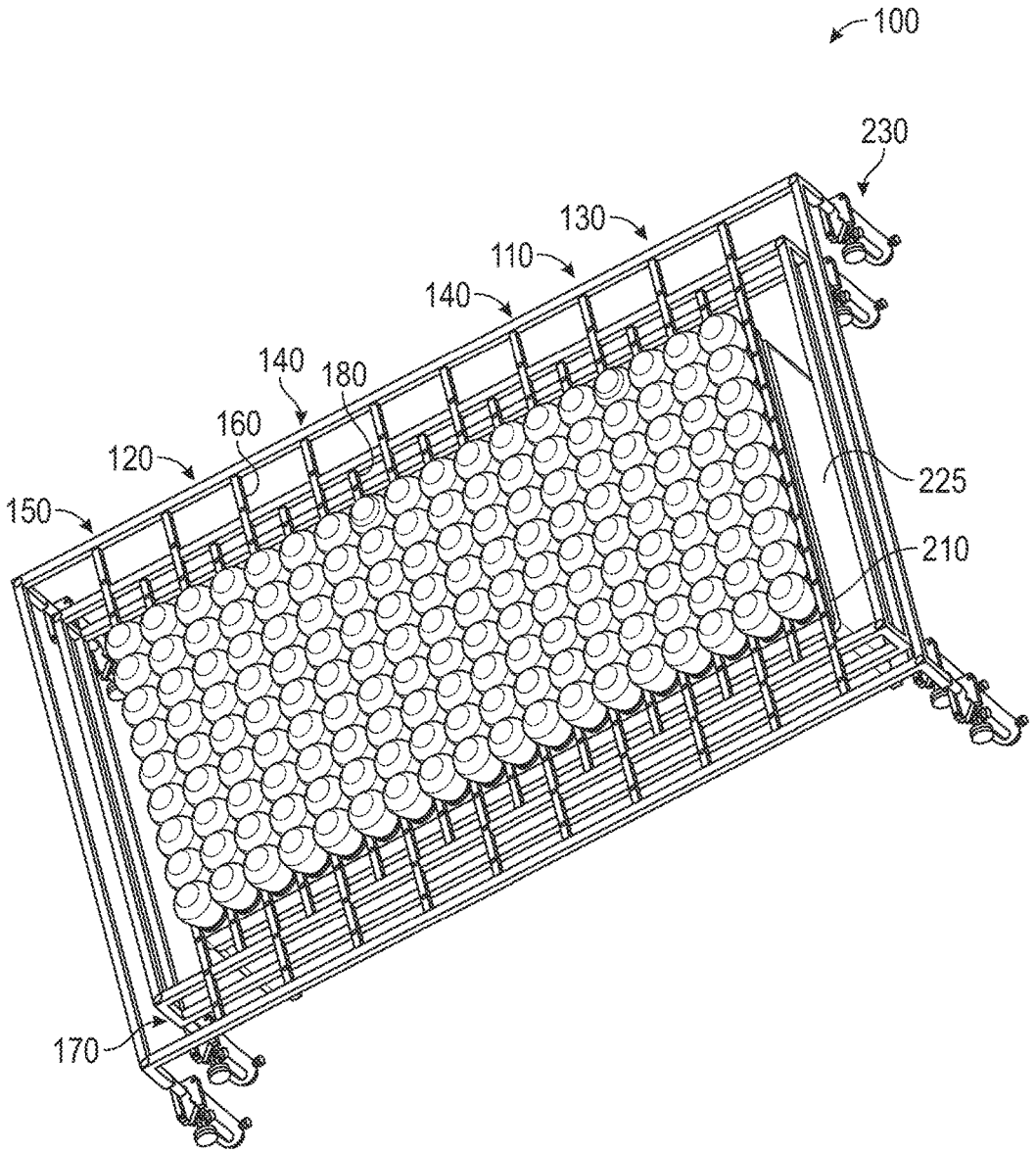
FIG. 2 is a perspective view of the system of FIG. 1.
Figure 3:
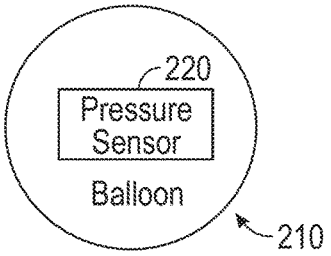
FIG. 3 is a block diagram illustrating an embodiment of a balloon and pressure sensor of the system of FIG. 1.
Figure 4:
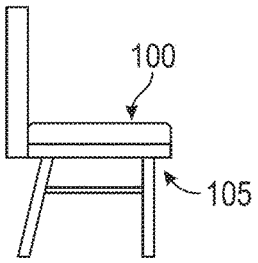
FIG. 4 is a block diagram illustrating an embodiment of a seat incorporating the system of FIG. 1.

With reference to FIGS. 1-6, an embodiment of a system (e.g., hospital bed) 100 for treating and preventing pressure sores in bedridden patients will be described. Although the system 100 is shown and described as a unique hospital bed, one or more features of the system 100 may be implemented in other types of beds, other support surfaces, and/or other types of seats 105 (FIG. 4) such as, but not limited to, wheel chair seating, seats in automobiles, airplanes, workplace seats in factories and offices, back massage chairs.

The system 100 includes a movable support frame assembly 110 including a first support frame assembly 120 hingeably attached (e.g., via one or roller hinges) to a second support frame assembly 130 at hinge/pivot points 140. The hinge/pivot points 140 may have underlying vertical support in the area of the hinge/pivot points 140. The movable support frame assembly 110 includes a rectangular outer support frame 150 with rods 160 spanning laterally across the rectangular outer support frame 150 and evenly spaced in a longitudinal direction along most of the length of the rectangular outer support frame 150. The movable support frame assembly 110 includes a rectangular inner support frame 170 with rods 180 spanning laterally across the rectangular inner support frame 170 and evenly spaced in a longitudinal direction along most of the length of the rectangular inner support frame 170.

The rods 160, 180 include emitters/holes 190, 200 for oxygenation and water-jets, respectively. The emitters/holes 190, 200 alternate (e.g., oxygen, water, oxygen, water, etc.).

Alternatively, the movable support frame assembly 110 includes a single support frame with rods 160 and/or rods 180 (i.e., not outer and inner support frames 150, 170).

Alternatively, the movable support frame assembly 110 includes a grill-like frame with horizontal and longitudinal rods 160, 180 to lift the patient.

Horizontal and vertical rows of an array of expandable and collapsible supports (e.g., inflatable) balloons 210 with pressure sensors/transducers 220 (see FIG. 3) connected to inner lining of balloons 210 are carried by an underlying mattress foundation/box spring 225 of the movable support frame assembly 110. In an alternative embodiment, where there are no rods 160, 180 and corresponding assembly 110, the underlying mattress foundation/box spring 225 includes the emitters/holes 190, 200 and the underlying mattress foundation/box spring 225 is only used to lift the patient.

The balloons 210 are made of polyurethane foam and/or other materials, and their size can range from ultra-small to large. Ultra-small balloons have smaller pores for oxygenation in the interstitial spaces. These ultra-small and small balloons may be used for wheelchairs and other forms of resting chair/seating for disabled and chronically ill. The support frame assembly 110 preferably includes raised edges surrounding the array of balloon 210 to hold the balloons 210 in position and prevent the balloons 210 from moving outside of the bed/system 100. The array of balloons 210 form an unstitched mattress for the patient to rest on and allows for monitoring of pressure in each balloon 210 and adjustment of the air pressure in the balloon 210 as required. The horizontal rods 160, 180 lay within the array of balloons 210 to allow oxygenation and water jet massage of the back of the patient through interstitial spaces 228 between the balloons. The interstitial spaces 228 always remains open to oxygen flow even when the patient is resting on the balloons 210. The horizontal rods 160, 180 may be flat ribbon frame with soft velvet-like covering to comfort the back of the patient when elevated by lifting the rods 160, 180.

Actuators (e.g., pneumatic actuators) 230 vertically move the first support frame assembly 120 and/or the second support frame assembly 130 of the support frame assembly 110 to move the horizontal rods 160, 180 for lifting/moving/elevating the patient. The hinge points 140 on the support frame assembly 110 allow lifting of the torso or the lower extremities only. Alternatively and/or additionally, the entire the support frame assembly 110 is elevated to clean the patient's back. Actuators 230 may raise either both the first support frame assembly 120 and the second support frame assembly 130 or just the second support frame assembly 130 of the support frame assembly 110 to move the horizontal rods 160 to clean the sections of the patient's back which would otherwise be covered by horizontal rods 180. Longitudinal spacing between these rods is optimized to allow comfortable resting of the patient only on support frame assembly 130.

Alternatively, the system 100 includes a hammock-like mat (e.g., horizontal and vertical ropes of intertwined fibers) of ultra-strong fiber-like Kevlar or other high tension materials. The patient is lifted above the balloons 210 to lie in the hammock-like mat.

Figure 5:
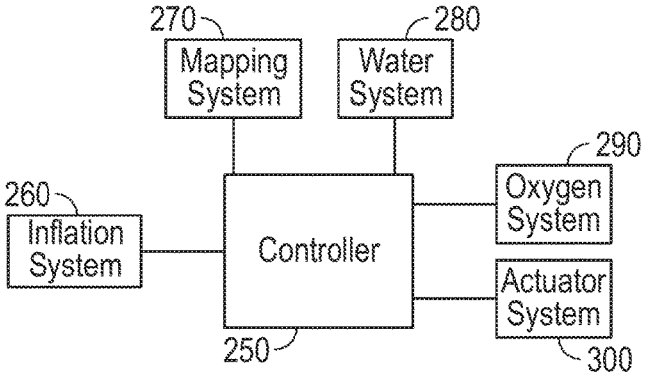
FIG. 5 is a block diagram of a control system of the system of FIG. 1.

With reference to FIG. 5, the system 100 includes a controller 250, an inflation system 260, a pressure mapping system 270, a water/irrigation system 280, an oxygen system 290, and an actuator system 300.

The inflation system 260 is controlled by the controller 250 to adjust the air pressure in each balloon 210 in order to adjust the amount of support pressure provided by each of the balloons 210 to the patient. The inflation system 260 may include one or more inflation devices (e.g., compressor(s)), one or more inflation tubes, one or more valves, one or more manifolds, and/or one or more other inflation-related connectors/mechanisms to individually control the air pressure in each balloon 210.

The pressure mapping system 270 is controlled by the controller 250 to monitor the air pressure in each balloon 210 through the pressure sensor(s) 220 and cooperates with the inflation system to allow pressure adjustments of the air pressure in each balloon 210, as required. In an alternative embodiment, the inflation system 260 and the pressure mapping system 270 collectively form a single mapping/pressure system.

The water system 280 is controlled by the controller 250 to massage and/or clean the patient's back. Water from a water source is emitted under pressure out of the water holes/jets 180 massage the patient's back/rear side.

The oxygen system 290 is controlled by the controller 250 to oxygenate the patient's back/rear side. Oxygen from an oxygen source is emitted under pressure out of the oxygen holes 160 and onto the patient's back/rear side.

The actuator system 300 is controlled by the controller 250 to cause the pneumatic actuators 230 to vertically move the first support frame assembly 120 and/or the second support frame assembly 130 to move the horizontal rods 160, 180 for lifting/moving/elevating the patient. The hinge points 140 on the support frame assembly 110 allow lifting of the torso, the lower extremities, and/or the patient's entire body (e.g., to clean the patient's back).

Figure 6:
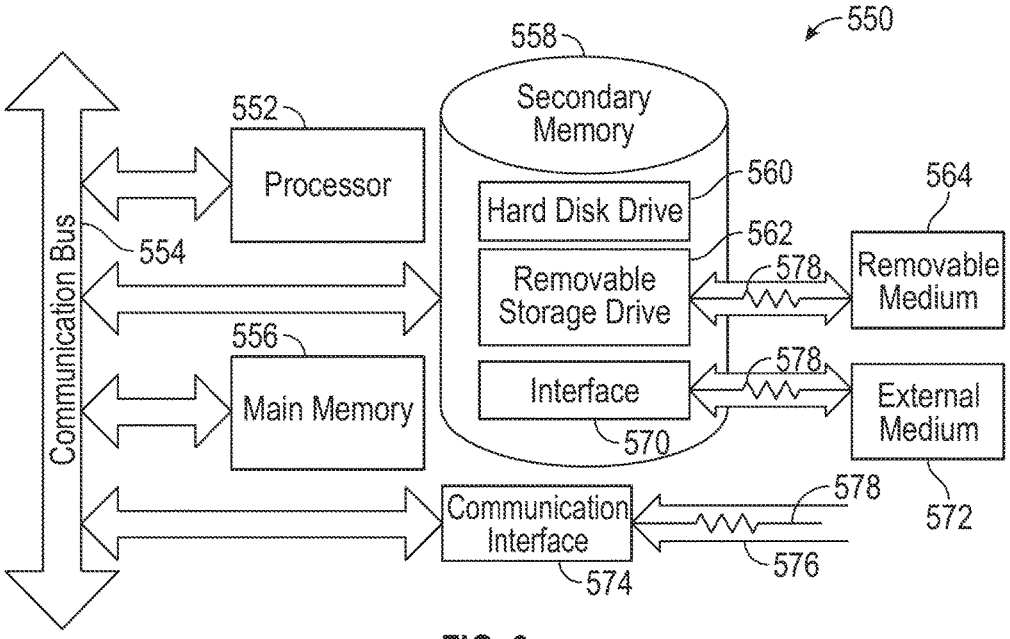
FIG. 6 is a block diagram illustrating an example computer system that may be used in connection with various embodiments described herein.

FIG. 6 is a block diagram illustrating an example computer system 550 that may be used in connection with various embodiments described herein such as the controller 250 in connection with the inflation system 260, the pressure mapping system 270, the water/irrigation system 280, the oxygen system 290, and/or the actuator system 300. However, other computer systems and/or architectures may be used, as will be clear to those skilled in the art.

The computer system 550 preferably includes one or more processors, such as processor 552. Additional processors may be provided, such as an auxiliary processor to manage input/output, an auxiliary processor to perform floating point mathematical operations, a special-purpose microprocessor having an architecture suitable for fast execution of signal processing algorithms (e.g., digital signal processor), a slave processor subordinate to the main processing system (e.g., back-end processor), an additional microprocessor or controller for dual or multiple processor systems, or a coprocessor. Such auxiliary processors may be discrete processors or may be integrated with the processor 552.

The processor 552 is preferably connected to a communication bus 554. The communication bus 554 may include a data channel for facilitating information transfer between storage and other peripheral components of the computer system 550. The communication bus 554 further may provide a set of signals used for communication with the processor 552, including a data bus, address bus, and control bus (not shown). The communication bus 554 may comprise any standard or non-standard bus architecture such as, for example, bus architectures compliant with industry standard architecture ("ISA"), extended industry standard architecture ("EISA"), Micro Channel Architecture ("MCA"), peripheral component interconnect ("PCI") local bus, or standards promulgated by the Institute of Electrical and Electronics Engineers ("IEEE") including IEEE 488 general-purpose interface bus ("GPIB"), IEEE 696/S-100, and the like.

Computer system 550 preferably includes a main memory 556 and may also include a secondary memory 558. The main memory 556 provides storage of instructions and data for programs executing on the processor 552. The main memory 556 is typically semiconductor-based memory such as dynamic random access memory ("DRAM") and/or static random access memory ("SRAM"). Other semiconductor-based memory types include, for example, synchronous dynamic random access memory ("SDRAM"), Rambus dynamic random access memory ("RDRAM"), ferroelectric random access memory ("FRAM"), and the like, including read only memory ("ROM").

The secondary memory 558 may optionally include a hard disk drive 560 and/or a removable storage drive 562, for example a floppy disk drive, a magnetic tape drive, a compact disc ("CD") drive, a digital versatile disc ("DVD") drive, etc. The removable storage drive 562 reads from and/or writes to a removable storage medium 564 in a well-known manner. Removable storage medium 564 may be, for example, a floppy disk, magnetic tape, CD, DVD, etc.

The removable storage medium 564 is preferably a computer readable medium having stored thereon computer executable code (i.e., software) and/or data. The computer software or data stored on the removable storage medium 564 is read into the computer system 550 as electrical communication signals 578.

In alternative embodiments, secondary memory 558 may include other similar means for allowing computer programs or other data or instructions to be loaded into the computer system 550. Such means may include, for example, an external storage medium 572 and an interface 570. Examples of external storage medium 572 may include an external hard disk drive or an external optical drive, or and external magneto-optical drive.

Other examples of secondary memory 558 may include semiconductor-based memory such as programmable read-only memory ("PROM"), erasable programmable read-only memory ("EPROM"), electrically erasable read-only memory ("EEPROM"), or flash memory (block oriented memory similar to EEPROM). Also included are any other removable storage units 572 and interfaces 570, which allow software and data to be transferred from the removable storage unit 572 to the computer system 550.

Computer system 550 may also include a communication interface 574. The communication interface 574 allows software and data to be transferred between computer system 550 and external devices (e.g. printers), networks, or information sources. For example, computer software or executable code may be transferred to computer system 550 from a network server via communication interface 574. Examples of communication interface 574 include a modem, a network interface card ("NIC"), a communications port, a PCMCIA slot and card, an infrared interface, and an IEEE 1394 fire-wire, just to name a few.

Communication interface 574 preferably implements industry promulgated protocol standards, such as Ethernet IEEE 802 standards, Fiber Channel, digital subscriber line ("DSL") asynchronous digital subscriber line ("ADSL"), frame relay, asynchronous transfer mode ("ATM"), integrated digital services network ("ISDN"), personal communications services ("PCS"), transmission control protocol/Internet protocol ("TCP/IP"), serial line Internet protocol/point to point protocol ("SLIP/PPP"), and so on, but may also implement customized or non-standard interface protocols as well.

Software and data transferred via communication interface 574 are generally in the form of electrical communication signals 578. These signals 578 are preferably provided to communication interface 574 via a communication channel 576. Communication channel 576 carries signals 578 and can be implemented using a variety of wired or wireless communication means including wire or cable, fiber optics, conventional phone line, cellular phone link, wireless data communication link, radio frequency (RF) link, or infrared link, just to name a few.

Computer executable code (i.e., computer programs or software) is stored in the main memory 556 and/or the secondary memory 558. Computer programs can also be received via communication interface 574 and stored in the main memory 556 and/or the secondary memory 558. Such computer programs, when executed, enable the computer system 550 to perform the various functions of the present invention as previously described.

In this description, the term "computer readable medium" is used to refer to any media used to provide computer executable code (e.g., software and computer programs) to the computer system 550. Examples of these media include main memory 556, secondary memory 558 (including hard disk drive 560, removable storage medium 564, and external storage medium 572), and any peripheral device communicatively coupled with communication interface 574 (including a network information server or other network device). These computer readable mediums are means for providing executable code, programming instructions, and software to the computer system 550.

In an embodiment that is implemented using software, the software may be stored on a computer readable medium and loaded into computer system 550 by way of removable storage drive 562, interface 570, or communication interface 574. In such an embodiment, the software is loaded into the computer system 550 in the form of electrical communication signals 578. The software, when executed by the processor 552, preferably causes the processor 552 to perform the inventive features and functions previously described herein.

Various embodiments may also be implemented primarily in hardware using, for example, components such as application specific integrated circuits ("ASICs"), or field programmable gate arrays ("FPGAs"). Implementation of a hardware state machine capable of performing the functions described herein will also be apparent to those skilled in the relevant art. Various embodiments may also be implemented using a combination of both hardware and software.

Furthermore, those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a module, block, circuit or step is for ease of description. Specific functions or steps can be moved from one module, block or circuit to another without departing from the invention.

Moreover, the various illustrative logical blocks, modules, and methods described in connection with the embodiments disclosed herein can be implemented or performed with a general purpose processor, a digital signal processor ("DSP"), an ASIC, FPGA or other programmable logic device, discrete gate or transistor logic, discrete hardware components, or any combination thereof designed to perform the functions described herein. A general-purpose processor can be a microprocessor, but in the alternative, the processor can be any processor, controller, micro controller, or state machine. A processor can also be implemented as a combination of computing devices, for example, a combination of a DSP and a microprocessor, a plurality of microprocessors, one or more microprocessors in conjunction with a DSP core, or any other such configuration.

Additionally, the steps of a method or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium including a network storage medium. An exemplary storage medium can be coupled to the processor such the processor can read information from, and write information to, the storage medium. In the alternative, the storage medium can be integral to the processor. The processor and the storage medium can also reside in an ASIC.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A system for preventing and treating pressure sores of a patient, comprising:

an array of expandable and collapsible supports to support and provide pressure relief to a patient in pressure locations where the expandable and collapsible supports support the patient;

pressure sensors associated with the expandable and collapsible supports to monitor pressure locations where the expandable and collapsible supports support the patient;

a patient lift movable between the expandable and collapsible supports to elevate one or more areas of the patient, the patient lift including at least one of one or more oxygen emitters to oxygenate one or more areas of the patient and one or more water emitters to rinse one or more areas of the patient, wherein the expandable and collapsible supports touch adjacent expandable and collapsible supports on all sides upon expansion so that the array of expandable and collapsible supports make a contiguous mattress except that the expandable and collapsible supports are unstitched.

2. The system of claim 1, wherein the system is a hospital bed.

3. The system of claim 1, wherein the system is a seat that is a member of the group consisting of wheel chair seating, seats in automobiles, seats in airplanes, workplace seats in factories, workplace seats in offices, and back massage chairs.

4. The system of claim 1, wherein the lift includes multiple actuators that elevate the patient to clean a back of the patient.

5. The system of claim 1, wherein the expandable and collapsible supports provide pressure relief and the one or more oxygen emitters provide oxygenation without elevating the patient with the patient lift.

6. The system of claim 1, wherein the expandable and collapsible supports are inflatable balloons.

7. The system of claim 6, wherein the inflatable balloons are embedded with the pressure sensors.

8. The system of claim 1, wherein the lift includes one or more hinges, enabling the lift to lift the patient's torso alone, the patient's lower extremities alone, or the patient's entire body.

9. A system for preventing and treating pressure sores of a patient, comprising:

an array of expandable and collapsible supports to support and provide pressure relief to a patient in pressure locations where the expandable and collapsible supports support the patient;

pressure sensors associated with the expandable and collapsible supports to monitor pressure locations where the expandable and collapsible supports support the patient;

a patient lift movable between the expandable and collapsible supports to elevate one or more areas of the patient, the patient lift including at least one of one or more oxygen emitters to oxygenate one or more areas of the patient and one or more water emitters to rinse one or more areas of the patient, wherein the array of expandable and collapsible supports include interstitial spaces between the expandable and collapsible supports and at least one of the one or more oxygen emitters are disposed in the interstitial spaces to emit oxygen there through to oxygenate one or more areas of the patient and the one or more water emitters are disposed in the interstitial spaces to rinse one or more areas of the patient.

10. The system of claim 9, wherein the expandable and collapsible supports touch adjacent expandable and collapsible supports on all sides upon expansion so that the array of expandable and collapsible supports make a contiguous mattress except that the expandable and collapsible supports are unstitched.

11. A system for preventing and treating pressure sores of a patient, comprising:

an array of expandable and collapsible supports to support and provide pressure relief to a patient in pressure locations where the expandable and collapsible supports support the patient;

pressure sensors associated with the expandable and collapsible supports to monitor pressure locations where the expandable and collapsible supports support the patient;

a patient lift movable between the expandable and collapsible supports to elevate one or more areas of the patient, the patient lift including at least one of one or more oxygen emitters to oxygenate one or more areas of the patient and one or more water emitters to rinse one or more areas of the patient, wherein the lift includes horizontal rods disposed between the expandable and collapsible supports, and the horizontal rods include the at least one of the one or more oxygen emitters and the one or more water emitters.

12. The system of claim 11, wherein the expandable and collapsible supports touch adjacent expandable and collapsible supports on all sides upon expansion so that the array of expandable and collapsible supports make a contiguous mattress except that the expandable and collapsible supports are unstitched.

* * * * *